US006775851B1

(12) United States Patent
Chen et al.

(10) Patent No.: US 6,775,851 B1
(45) Date of Patent: Aug. 17, 2004

(54) STRUCTURE OF CHEST PROTECTOR

(76) Inventors: Shyan-Wei Chen, No. 17, Kung 6 Road, Linkou 2nd Industrial Park, Taipei Hsien (TW); Stan M. Jurga, P.O. Box 1356, 1 Main St., Shirley, MA (US) 01464

( * ) Notice: Subject to any disclaimer, the term of this patent is extended or adjusted under 35 U.S.C. 154(b) by 0 days.

(21) Appl. No.: 10/753,441

(22) Filed: Jan. 9, 2004

(51) Int. Cl.[7] ..... A41D 13/00
(52) U.S. Cl. ..... 2/463
(58) Field of Search ..... 2/464–467, 455, 2/2.5, 468, 462, 102, 913, 92, 94

(56) References Cited

U.S. PATENT DOCUMENTS 3,076,197 A * 2/1963 Glahe ..... 2/463
3,125,762 A * 3/1964 Glahe ..... 2/463
4,272,847 A * 6/1981 Buhler ..... 2/463
4,847,913 A * 7/1989 Chen ..... 2/463
5,168,576 A * 12/1992 Krent et al. ..... 2/456
6,182,299 B1 * 2/2001 Chen ..... 2/463

* cited by examiner

*Primary Examiner*—Tejash Patel
(74) *Attorney, Agent, or Firm*—Troxell Law Office PLLC

(57) ABSTRACT

A chest protector formed of a base, upper and lower shoulder straps for securing the base to the user's chest, a neck pad and a number of cushions mounted on the base, the cushions having air vents in communication with air vents in the base for ventilation, colored breathing cloths fastened to the base and covered on the cushions for breathing and decoration, and a substantially triangular saddle strap coupled between said upper shoulder straps and said lower shoulder straps to keep upper and lower shoulder straps in close contact with the user's back comfortably.

1 Claim, 9 Drawing Sheets

STRUCTURE OF CHEST PROTECTOR

BACKGROUND AND SUMMARY OF THE INVENTION

The present invention relates to a chest protector for baseball game and, more particularly to a breathing chest protector, which gives a comfortable wearing.

A chest protector for baseball game generally comprises a base, a plurality of cushions mounted on the base, and a breathing cloth covering the cushions on the base. Air vents may be made in the cushions for ventilation. FIG. 1 shows a chest protector according to the prior art. According to this design, the chest protector comprises a plurality of air vents 911 in the base 9 between each two adjacent cushions 91. However, this design does not provide a satisfactory breathing effect. Further, after fastening of the straps 92~96 to the user's body, the straps 92~96 are not constantly maintained in close contact with the user's body, giving an uncomfortable wearing.

The present invention has been accomplished under the circumstances in view. It is one object of the present invention to provide a chest protector, which keeps the base and the shoulder straps in close contact with the user's body for a comfortable wearing. It is another object of the present invention to provide a chest protector, which provides good ventilation. According to one aspect of the present invention, the chest protector is formed of a base, upper and lower shoulder straps, a neck pad, a number of cushions, and breathing cloths, wherein the cushions each have a plurality of air vents in communication with air vents in the base for ventilation. According to another aspect of the present invention, the breathing cloths have different colors, making the chest protector beautiful. According to still another aspect of the present invention, a substantially triangular saddle strap is coupled between the upper shoulder straps and the lower shoulder straps, keeping the upper and lower shoulder straps in close contact with the user's back comfortably.

DETAILED DESCRIPTION OF THE INVENTION

Figure 1:
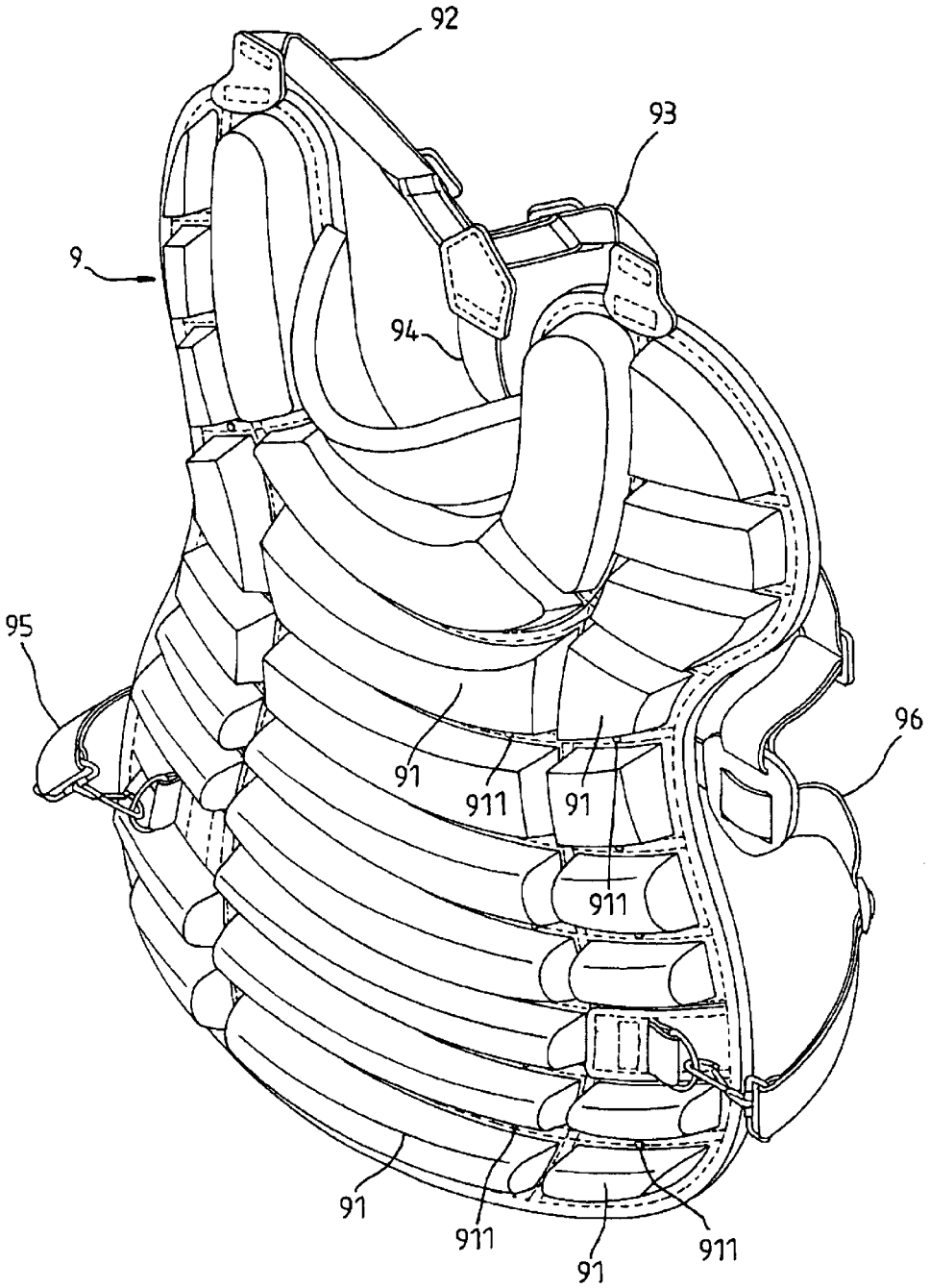
Fig. 1 PRIOR ART
FIG. 1 is an elevational view of a chest protector according to the prior art.
Figure 2:
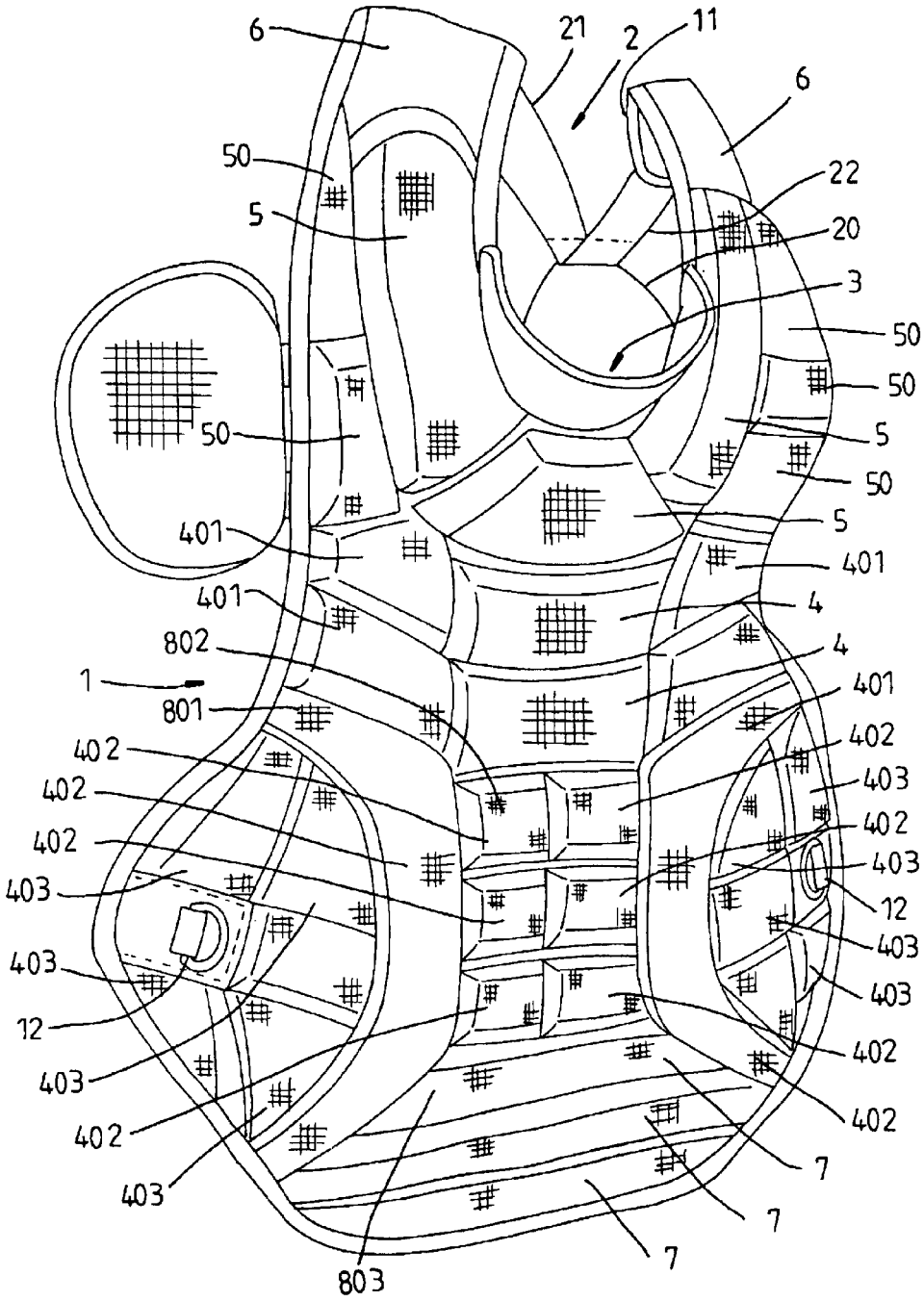
FIG. 2 is a perspective view of a chest protector according to the present invention.
Figure 3:
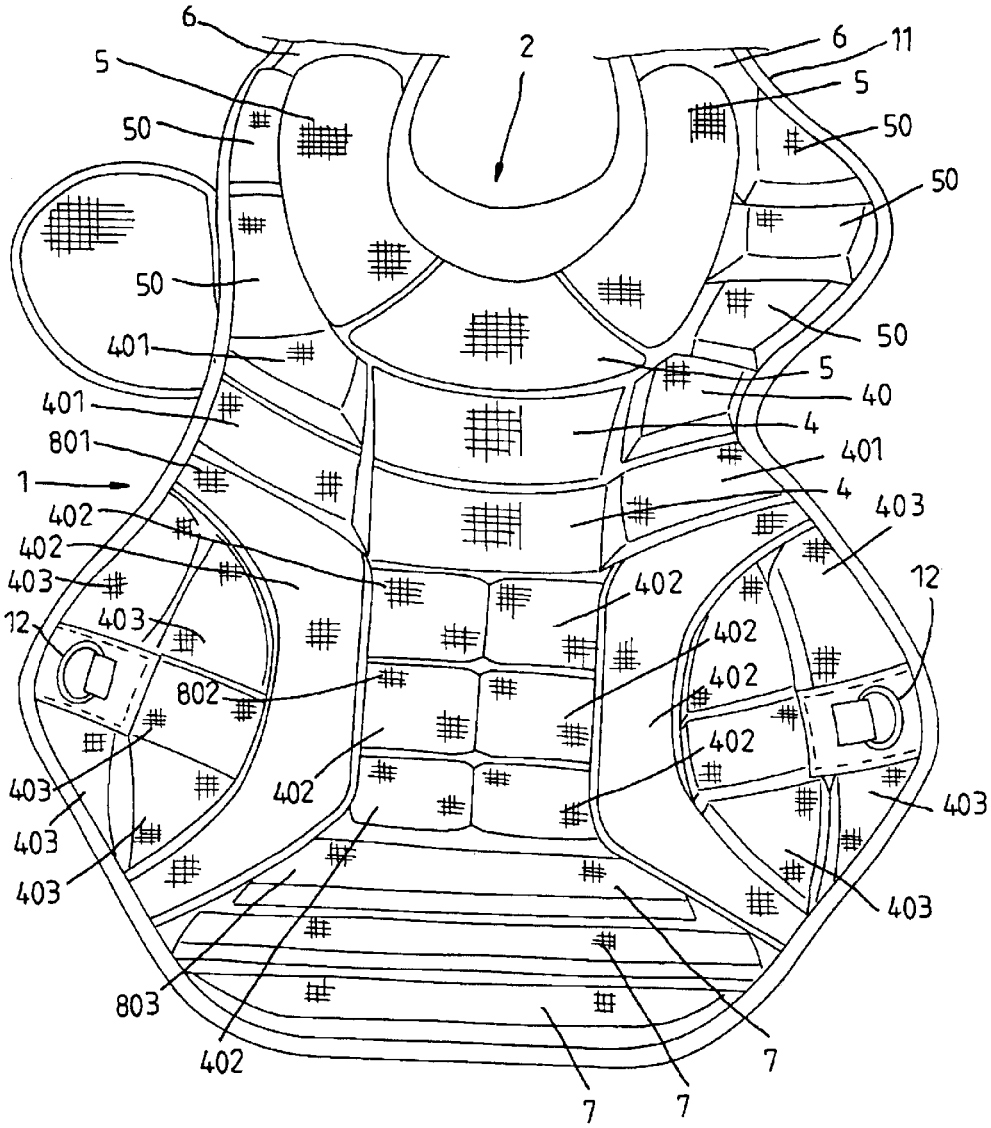
FIG. 3 is a front view of the chest protector according to the present invention.

Referring to FIGS. 2~10, a chest protector is shown comprising a base 1, a set of shoulder straps 2, a neck pad 3, a set of cushions 4;401;402;403;5;50;6;7, and breathing cloths 801;802;803;804.

The base 1 is made of ethylene vinyl acetate foam material not heat pressed, having a suitable thickness.

Figure 4:
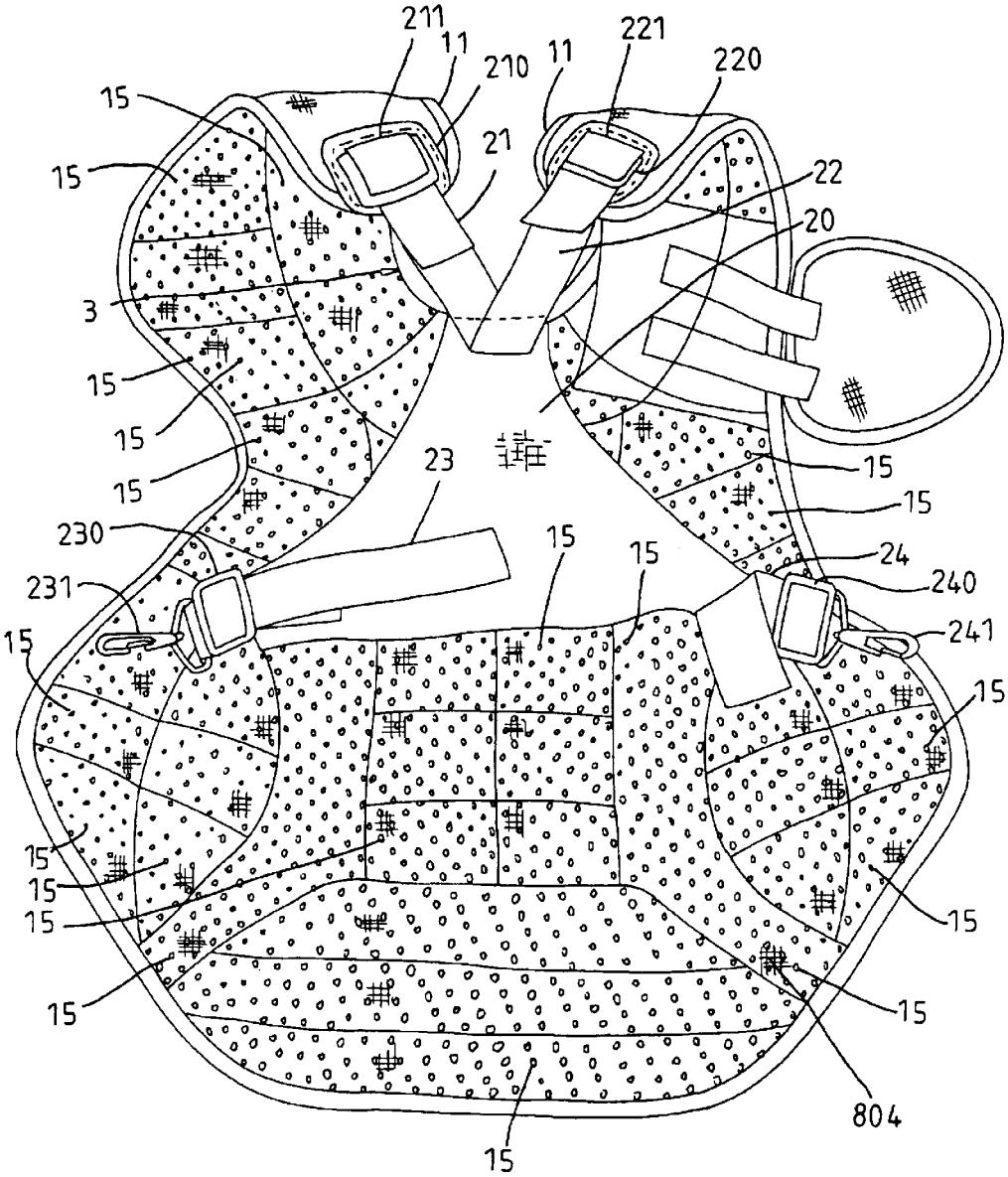
FIG. 4 is a rear view of the chest protector according to the present invention.
Figure 5:
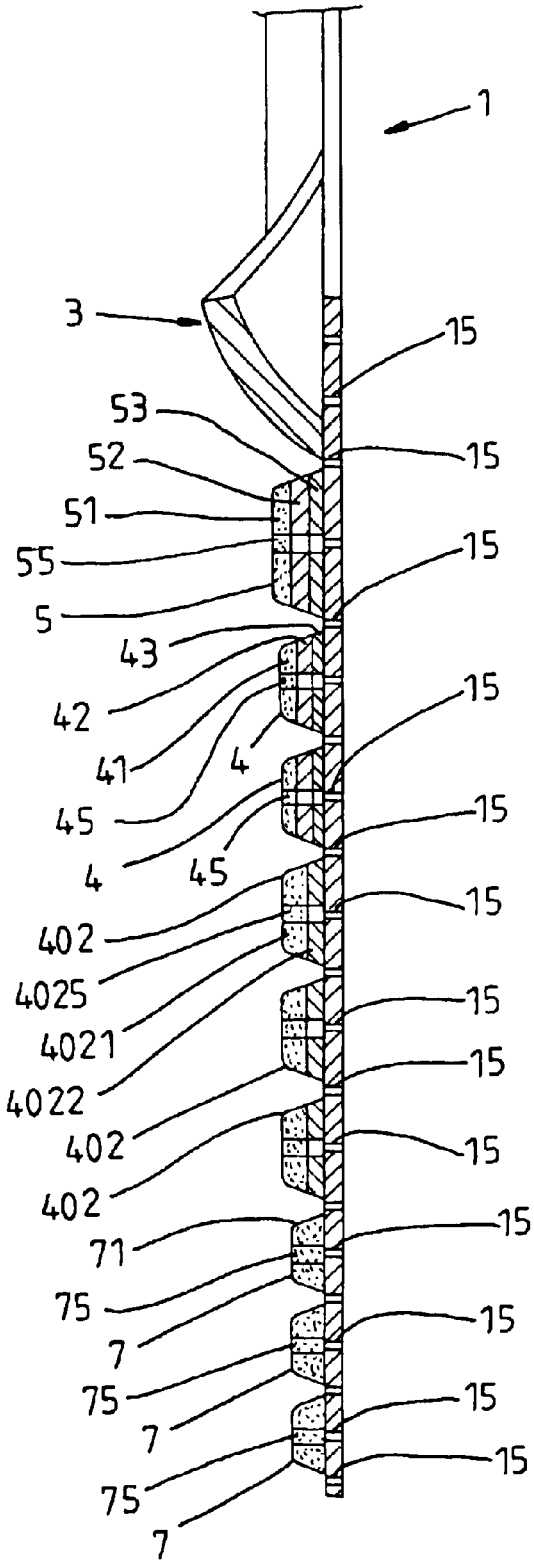
FIG. 5 is a sectional view of the present invention, showing the arrangement of the cushions on the base of the chest protector.
Figure 6:
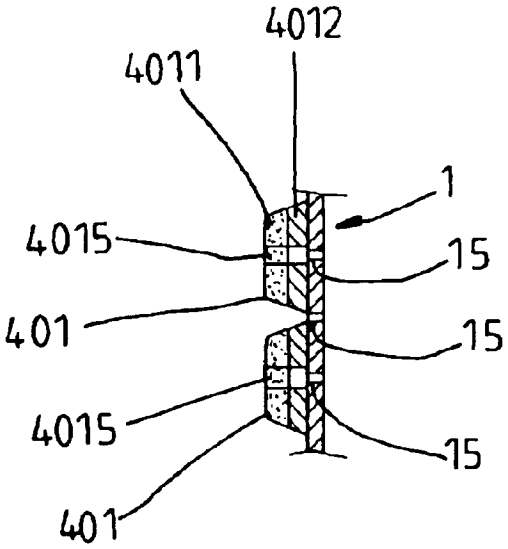
FIG. 6 is a sectional view of a part of the present invention, showing the arrangement of the cushions on the base corresponding to the upper part of the chest.
Figure 7:
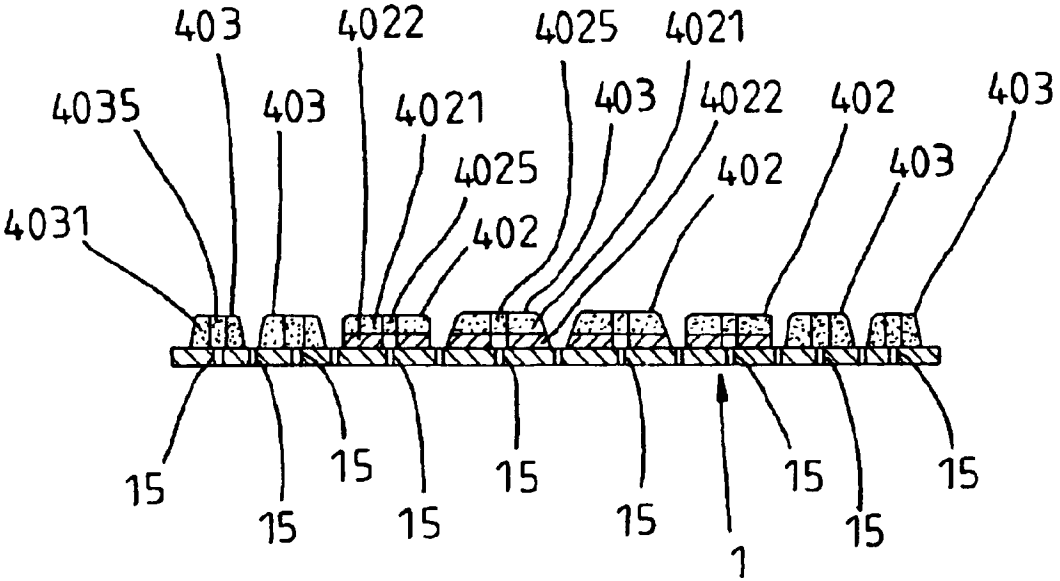
FIG. 7 is a sectional view of a part of the present invention, showing the arrangement of the cushions on the base corresponding to the lower part of the chest.
Figure 9:
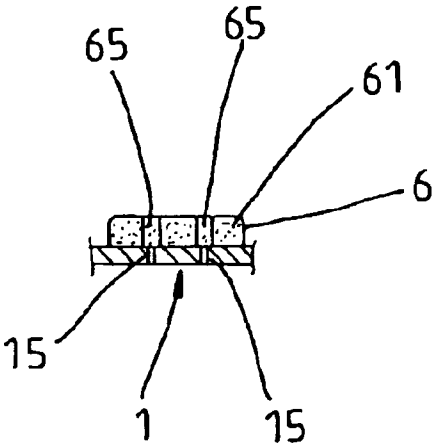
FIG. 9 is a sectional view of a part of the present invention, showing the arrangement of the cushion on the base corresponding to one shoulder.
Figure 8:
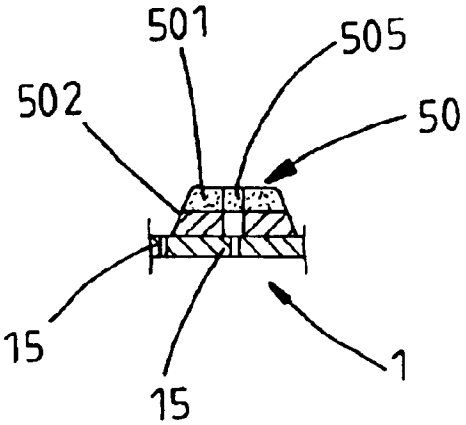
FIG. 8 is a sectional view of a part of the present invention, showing the arrangement of the cushion on the base corresponding to the area of the neck.
Figure 10:
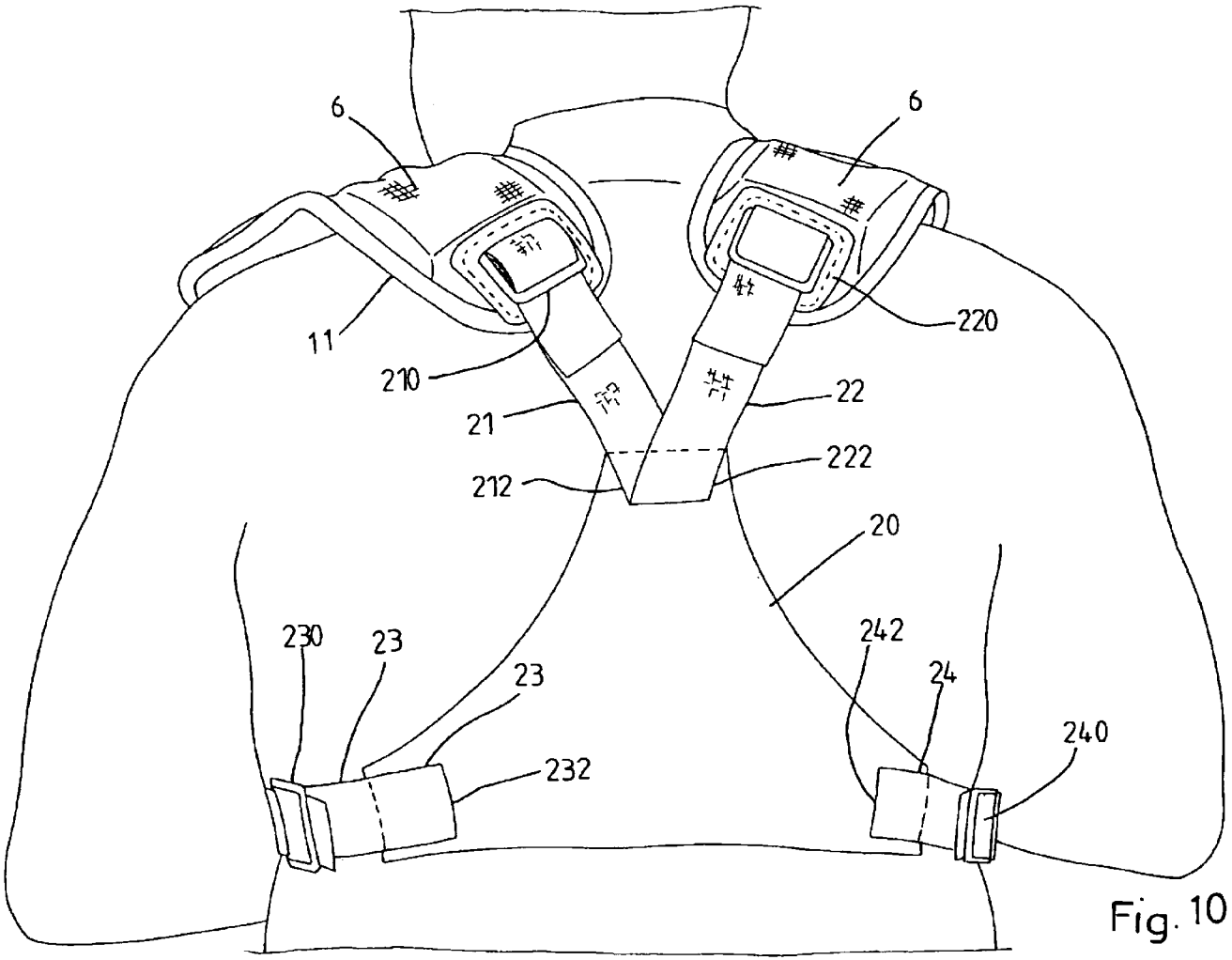
FIG. 10 is an enlarged rear view of a part of the present invention, showing the chest protector fastened to the user's back.

The set of shoulder straps 2 includes two shoulder straps 21;22 and two lower shoulder straps 23;24 (see FIG. 4). The upper shoulder straps 21;22 each are provided with a strap frame 210;220, having a top end 211;221 respectively connected to the shoulder portions 11 of the base 1, and a retaining The lower shoulder straps 23;24 each is provided with a strap frame 230;240, having one end 231;241 respectively connected to the two opposite lateral flank portions 12 of the base 1.

The neck pad 3 is fastened to the top side of the base 1 corresponding to the user's neck.

The cushions 4;401;402;403;5;50;6;7 are respectively fastened to the front side of the base 1 corresponding to the areas of the user's chest, neck, shoulders and abdomen. According to the present preferred embodiment, the cushions 4;5 fastened to the base 1 corresponding to the upper part of the chest and the neck each are comprised of an outer foam layer 41;51, a heat-pressed inner ethylene vinyl acetate foam layer 43;53, and an intermediate polyethylene board 42;52 sandwiched in between the outer foam layer 41;51 and the inner ethylene vinyl acetate foam layer 43;53 (see FIG. 5). The cushions 401;402;50 fastened to the base 1 corresponding to the two opposite lateral sides of the upper part of the check and the lower part of the chest and the two opposite lateral sides of the neck each are comprised of an outer foam layer 4011;4021;501 and a heat-pressed inner ethylene vinyl acetate foam layer 4012;4022;502 (see FIGS. 6~8). The cushions 6;403;7 fastened to the base 1 corresponding to the shoulders, the two opposite lateral sides of the lower part of the chest and the abdomen each are comprised of a heat-pressed EVA foam layer 61;4031;71 (see FIGS. 5, 7, and 9).

The breathing cloths 801;802;803;804 are stitched to the base 1 and covered on the neck pad 3 and the cushions 4;401;402;403;5;50;6;7.

The main features of the present invention are outlined hereinafter with reference to FIGS. 5~9. The cushions 4;401;402;403;5;50;6;7 each have a plurality of air vents 45;4015;4025;4035;55;505;65;75 respectively disposed in communication with air vents 15 in the base 1 for ventilation, giving a comfortable wearing. The upper shoulder straps 21;22 each have a bottom end 212;222 respectively fastened to the top side of a substantially triangular saddle strap (connecting strap) 20, which has two ends of the bottom side respectively fastened to the other ends 232;242 of the lower shoulder straps 23;24. By means of the saddle strap 20, the shoulder straps 21;22;23;24 are maintained in close contact with the user's back comfortably (see FIG. 10).

As indicated, the chest protector of the present invention provides the following advantages.

1. The base 1 has air vents 15 disposed in communication with the air vents 45; 4015; 4025; 4035; 55; 505; 65; 75 of the cushions 4; 401; 402; 403; 5; 50; 6; 7 for ventilation, and the back of the base 1 is maintained in direct contact with the user. Therefore, the chest protector gives a comfortable wearing.

2. The saddle strap 20 is made of a flexible rubber foam material and connected between the upper shoulder straps 21;22 and the lower shoulder straps 23;24, keeping the shoulder straps 21;22;23;24 in close contact with the user's back for a comfortable wearing.

3. The breathing cloths 801;802;803;804 can be made in different colors, making the chest protector beautiful.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A chest protector comprising:

a base made of EVA (ethylene vinyl acetate) foam material not heat pressed; said base having a plurality of air vents;

two upper shoulder straps and two lower shoulder straps respectively provided at a back side of said base and adapted to fasten said base to the user's shoulders;

a neck pad fastened to a top side of said base corresponding to the user's neck;

a plurality of cushions respectively fastened to a front side of said base corresponding to the user's chest, neck, shoulders and abdomen; and a plurality of breathing cloths stitched to said base and covered on said neck pad and said cushions;

wherein said cushions each have a plurality of air vents respectively disposed in communication with the air vents of said base for ventilation; a substantially triangular saddle strap is coupled between said upper shoulder straps and said lower shoulder straps, said saddle strap being formed of a flexible rubber foam material; said upper shoulder straps each have a top end connected to said base and a bottom end respectively fastened to a top side of said saddle strap; said lower shoulder straps each have a bottom end connected to said base and a top end respectively connected to a bottom side of said saddle strap.

* * * * *